United States Patent [19]

Poshkus et al.

[11] 4,247,626

[45] Jan. 27, 1981

[54] FLUID RECEIVING TRAP

[75] Inventors: Gerald M. Poshkus, Rochester; Dennis E. Whitney, Fairport; James N. Cope, Rochester, all of N.Y.; Robert J. Borel, Columbus, Ohio

[73] Assignee: Eastman Kodak Company, Rochester, N.Y.

[21] Appl. No.: 871,731

[22] Filed: Jan. 23, 1978

Related U.S. Application Data

[63] Continuation of Ser. No. 808,011, Jan. 20, 1977, abandoned, which is a continuation of Ser. No. 570,904, Apr. 23, 1975, abandoned.

[30] Foreign Application Priority Data

May 9, 1974 [GB] United Kingdom ..... 20580/74

[51] Int. Cl.[3] ..... G03C 1/48; G03D 9/02

[52] U.S. Cl. ..... 430/498; 354/304; 430/209; 430/497

[58] Field of Search ..... 96/76 C; 354/304; 430/209, 498, 497

[56] References Cited

U.S. PATENT DOCUMENTS

| | | | |
|---|---|---|---|
| 3,589,904 | 6/1971 | Chen | 96/76 C |
| 3,619,193 | 11/1971 | Knight | 96/76 C |
| 3,652,281 | 3/1972 | Bachelder et al. | 96/76 C |
| 3,689,269 | 9/1972 | Schieven | 96/76 C |
| 3,776,732 | 12/1973 | Frost et al. | 96/76 C |

*Primary Examiner*—Richard C. Schilling
*Attorney, Agent, or Firm*—J. A. Matthews

[57] ABSTRACT

In a photographic film unit having a pair of sheets connected in superposition with a photosensitive layer located between the sheets, a container carrying a quantity of fluent processing composition is arranged to provide for the discharge of the composition to between the sheets. A fluid receiver or trap is provided at the opposite edge of the sheets to receive and store excess processing composition after it has been spread between the sheets. The improvement comprises a trap construction wherein an intermediate sheet, which is disposed between the pair of sheets and is coupled to both of them, extends from between the pair of sheets at the trailing end thereof and is folded around one of the sheets at that end to form a trap cover over the trap volume between that folded portion and the outside surface of that one sheet. Spacing elements are formed by embossing the trailing end of that one sheet and fluid flow slits are formed by slitting the trailing edge of that sheet. The spacing elements assure a minimum trap size since the excess processing composition can be accommodated between the convex portions thereof and the trap cover as well as in the concave portions thereof between the pair of sheets.

13 Claims, 3 Drawing Figures

FLUID RECEIVING TRAP

This application is a continuation of U.S. patent application Ser. No. 808,011, filed on June 20, 1977, now abandoned, which is a continuation of U.S. patent application Ser. No. 570,904, filed Apr. 23, 1975, now abandoned, and claims a right of priority based on British patent application No. 20580/74 filed on May 9, 1974.

BACKGROUND OF THE INVENTION

Self-processing photographic film units are now available which are completely self-contained and are adapted to be employed in a camera in which the film unit is exposed and then processed by moving it between a pair of pressure-applying members. The components of the film unit are assembled to form an integral structure and the integrity of this structure is maintained during exposure, processing and viewing, thereby making it unnecessary to store, handle and/or move separately, individual elements of the film unit, and minimizing the complexity of the structure required to contain and manipulate the film unit to effect exposure and processing thereof. Such a film unit structure is attractive, includes a minimum of simple and easily assembled components, is of a minimum size in relation to image size and generally includes substantially no excess materials. The film unit includes a container of the processing fluid and means for promoting and facilitating spreading of the fluid in a layer of predetermined depth and extent.

Such film units generally comprise two separate, flexible sheetlike elements including a first or image-recording sheet including a layer containing a photosensitive image-recording material and a second sheet for aiding in the distribution of a viscous liquid processing agent as a layer in contact with an exposed area of the photosensitive material. A rupturable container filled with a fluent processing composition, is disposed along one edge of the film unit, in a manner well known in the art. After the viscous fluent processing composition has been spread from the leading end of the film unit between the sheets toward the trailing end thereof, excess processing fluid is trapped and retained within the film unit at the trailing end thereof.

In prior art film units of the general type described above, various means have been provided for forming a trapping volume or receiver at the edge of the film unit. Examples of such trap structures are illustrated in U.S. Pat. Nos. 3,589,904, 3,607,285, 3,619,193, 3,621,768, 3,689,269, 3,741,766 and 3,776,732. The trap structures of the U.S. Pat. Nos. 3,589,904, 3,621,768 and 3,741,766 patents all utilize spacer members, which space apart the pressure members in the trap area to permit the retention of the excess processing composition. These spacer members are formed from separate elements that must be handled by the assembly apparatus and be located in the individual film units within close tolerances. Moreover, each of the spacer members themselves occupy a significant amount of the trapping volume that might otherwise hold a portion of the excess composition. Thus, either the volume of excess processing composition that can be accommodated must be limited or the size of the trap must be enlarged.

The trap structures of the U.S. Pat. Nos. 3,589,904, 3,619,193, 3,689,269 and 3,776,732 patents utilize a portion of the end of one of the film unit sheets which is embossed to provide the spacing function of the spacer members noted above. However, the trap construction of these patents only utilize one surface of the embossed sheet whereby the potential trapping space is reduced by the embossed portions of the sheets.

With each of the foregoing trap constructions, except for the U.S. Pat. No. 3,607,285, it is possible for the excess processing composition in the trap to be forced, after spread, back into the image area to discolor or otherwise impair the visible image. The U.S. Pat. No. 3,607,285 illustrates an after-process seal between the trap and the image area that is intended to prevent such back flow. However, it has been found that such an after-process seal complicates the manufacture of the film unit and that it does not function sufficiently reliably to warrant its use.

SUMMARY OF THE INVENTION

In accordance with one aspect of the present invention there is provided a film unit comprising a photosensitive sheet and a second sheet, with a coupling member permanently securing the sheets together in superposed relationship. A container for processing composition is disposed at one end of the film unit and a trap for excess processing composition is disposed at the other end of the film unit. Trap spacing elements are provided including protuberances formed in an end portion of one of the sheets and extending away from the other of the sheets whereby a convexity on the side of the one sheet away from the other sheet has a corresponding concavity facing the other sheet. A trap cover of sheet material overlies the protuberances and bounds with the end portion of the one sheet a first trapping space to which excess processing composition may flow from between the sheets. The trap also includes a second volume between the sheets which is at least partially formed by the concavities of the protuberances.

In accordance with another aspect of the present invention there is provided a film unit comprising a photosensitive sheet and a second sheet, a coupling member permanently securing the sheets together along their lateral edges in superposed relationship, a container for processing composition disposed at one end of the film unit and a trap for excess processing composition disposed at the other end of the film unit, trap spacing elements including protuberances formed in an end portion of one of the sheets and extending away from the other of the sheets, the protuberances having been formed by embossing whereby a convexity on the side of the one sheet away from the other sheet has a corresponding concavity facing the other sheet, a trap cover of flexible sheet material overlying the protuberances and bounding with the end portion of said one sheet a first trapping space to which excess processing composition may flow from between the sheets, the trap including a second volume between the sheets at least partially formed by the concavities of the protuberances, and flow passage means at the end of said one sheet to permit flow of the excess processing composition from between the sheets to said first trapping space.

The various features of novelty which characterize the present invention are pointed out with particularity in the claims annexed hereto and forming part of this specification. For a better understanding of the invention, its operating advantages and the specific objects obtained by its use, reference should be had to the accompanying drawings and descriptive matter in which a preferred embodiment of the present invention is illustrated and described.

BRIEF DESCRIPTION OF THE DRAWINGS

FIG. 1 illustrates a film unit 10 incorporating a preferred embodiment of the present invention. The film unit has lateral and transverse edges and comprises a first sheet 12 which is provided on its inner surface with one or more photographic layers as disclosed, for example, in copending U.S. patent application Ser. Nos. 308,869, filed Nov. 22, 1972 in the names which issued as U.S. Pat. No. 3,880,658 on Apr. 29, 1975; and No. 351,673, filed Apr. 16, 1973 in the name of Fleckenstein et al; and Canadian Pat. No. 928,559. As the film unit is processed it is transported between a pair of pressure applying members with the transverse edge 13, adjacent the fluent processing-composition-containing container or pod 14, first. This transverse edge 13 is hereinafter referred to as the "leading" edge or end while the opposite transverse edge is called the "trailing" edge or end 15 of the film unit. In the film unit illustrated, the visible image occupies the area indicated by the dotted rectangle 16. In FIG. 1, portions of the film unit are broken away to show a portion of other elements of the film unit.

A second sheet 18, provided on its inner surface with suitable timing and neutralizing layers, is arranged in superposition with the first sheet 12 and is connected thereto by means of an intermediate sheet 20. As shown in FIG. 1, the second sheet 18 is substantially the same width as the first sheet 12, but is shorter. The difference in length between the first and second sheets 12 and 18 is just slightly greater than the narrow dimension of the fluid container or pod 14, i.e. the dimension of the pod from the leading end toward the trailing end of the film unit. The first and second sheets are superposed with the leading end 17 of the sheet 18 terminating short of the corresponding end of sheet 12.

The trailing end portion of the second sheet is provided with a plurality of circular protuberances or embossments 22 which form a plurality of convexities on the outer surface of that sheet and a plurality of corresponding concavities on the inner surface thereof. FIG. 2 shows a cross section through these embossments. These protuberances are arranged to space apart the pressure-applying members or rollers of a processing camera to assist in forming a trap or trapping volume or space 23 which receives and accommodates excess processing composition after it has been spread the length of the film unit. As illustrated, the protuberances are arranged in a plurality of rows extending transversely of the film unit, with the protuberances in one row offset from those in the adjacent row. A plurality of slits or perforations 24 are provided through the second sheet, between the trailing end and the protuberances, which act as flow passage means or valves that permit the excess processing composition forced to the trailing end of the film unit between the sheets to pass through the second sheet into the trapping space around the dimples between the outer surface of the second sheet and a trap cover 36.

Figure 3:
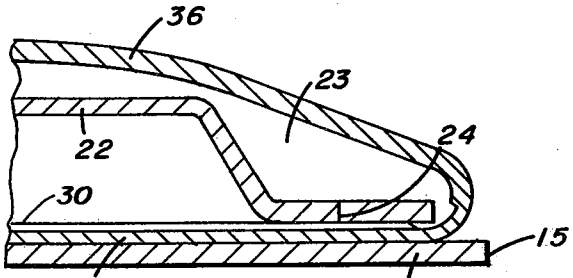
FIG. 3 is a partial cross section showing an alternate trailing end arrangement.

The intermediate sheet 20 extends between the first and second sheets and couples them together, provides a mask portion 26 which surrounds and forms an exposure aperture 28, which is excised from the intermediate sheet, and subsequently forms the periphery 16 of the visible image, provides the spacer rail portions 30 and 32, that give the requisite spacing between sheets 12 and 18 to furnish the necessary thickness of the processing composition which results in the desired photographic processing, and provides a pod-attaching cover 34 at one end and the trap cover 36 at the other end of the film unit.

The trap cover is formed by a portion of the intermediate sheet which extends from between the sheets at the trailing end of the film unit and is folded around the end of sheet 18, over the protuberances to be sealed to the outer surface of sheet 18 ahead of the protuberances in the region 60. Provision is also made in the trap cover of the present arrangement to permit the escape of air therefrom in a manner taught by U.S. Pat. No. 2,500,422. This air release provision may include portions which are left unsealed in the leading edge of the trap cover, or may be small perforations through the cover which permit the escape of air but prevent the escape of the processing composition. Alternatively, the trap cover in the vicinity of region 60 may be skived or ground to a thinner thickness in selected small regions of the inner surface, thereby providing escape passages for the release of air.

At least the mask portion 26 and preferably the entire intermediate sheet is opaque to the actinic radiation that expose the photosensitive layers on the first sheet. The trailing transverse edge **28*a* of the aperture is spaced from the trailing edge of the film unit by a distance slightly greater than the width of the trap 23. In the preferred embodiment illustrated, for example, the width of the trap is approximately twice the width of the lateral borders of the visible image and about one-half the width of the transverse border at the leading edge of the picture unit. The periphery of the mask portion 26 around aperture 28 is sealed to the inner surface of the first sheet 12 to prevent contact of the photographic layers on sheet 12 by the processing composition, except within the aperture area. Preferably the remainder of the intermediate sheet 20 in contact with the inner surface of the first sheet 12** is also sealed thereto to provide a substantially unitary assembly. Thus the mask portion prevents both the exposure of the image borders to the actinic radiation and to contact with the processing composition thereby assuring that the borders remain white.

The present trap construction provides a compartment for accepting the excess fluent processing composition that incorporates many advantages. Specifically, the utilization of protuberances 22 embossed in the second sheet to provide the necessary spacing of the pressure members as the trap passes therebetween eliminates the need for an additional spacing element which would complicate and make more expensive the fabrication of the film unit. More significantly, since the spacing elements have a concavity open to the space between the sheets, they also function as a portion of the trapping space. Thus, as the excess processing composition is spread past the trailing edge **28*a* of the image area, a portion of the excess is accommodated by the concavities of the protuberances 22 and a portion passes through slits 24 into the space around the convex portion of the protuberances between the outer surface of sheet 18 and the inner surface of the trap cover 36. Thus substantially the entire volume of the trapping region, on both sides of sheet 18 may be used, with a very minimum volume being occupied by the volume of the spacing element. In effect, only the thickness of sheet 18 detracts from the volume of the trap. Still further, the present trap construction provides a significant amount of the trapping volume on the back surface of the film unit without requiring a significant increase in film unit size since the excess processing composition is caused to reverse directions, as it flows through the slits 24**, toward the leading end of the film unit on the outside of the second sheet.

Figure 2:
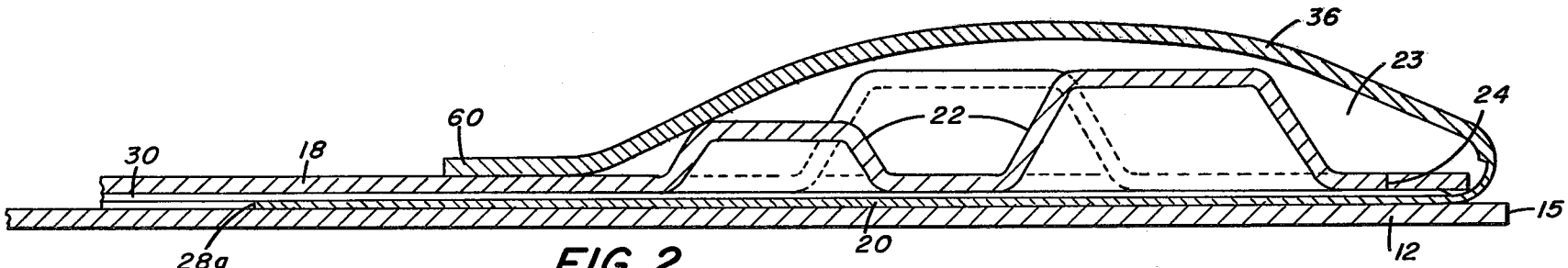
FIG. 2 is a partial cross section taken along line 2—2 of FIG. 1.
Figure 1:
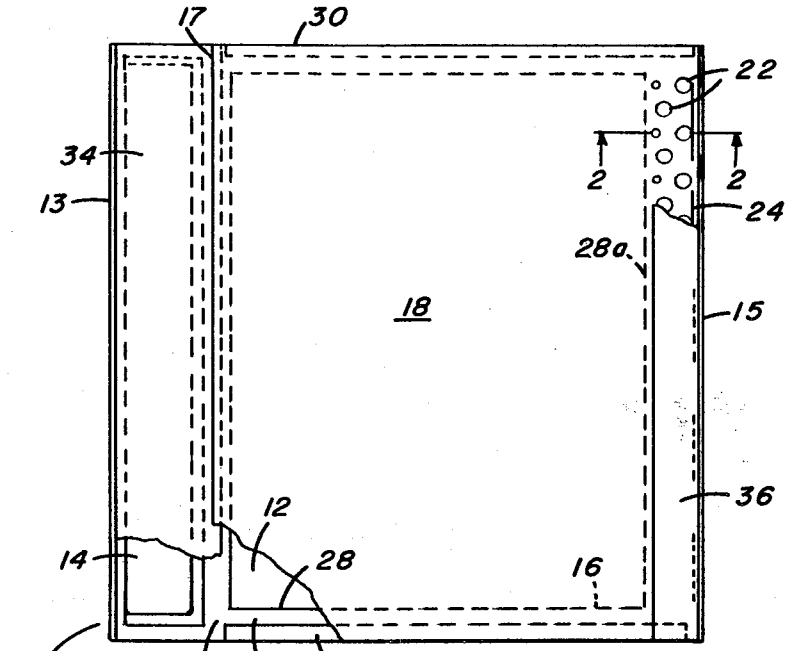
FIG. 1 is a rear view of a film unit incorporating a preferred embodiment of the present invention, with portions removed to show a portion of the inner construction.

The perforations or slits 24, which may either be straight, as shown, or arcuate, make it possible to substantially isolate the excess processing composition contained within the trap region 23 from the image area. This isolation occurs because the slits tend to only open under pressure in the composition generated by the pressure members, which pressure cannot be obtained by manipulation of the film unit after processing. Thus, the excess processing material is unlikely to be forced back into the image area after processing, thereby preventing the undesirable effects possible therefrom. The use of slits 24 assures that the excess composition can pass from between the sheets to the trapping space 23. While it is possible for the excess composition to pass around the trailing end of sheet 18, between that end edge and the trap cover 36 as shown in FIG. 3, it has been found that manufacturing tolerances obtainable in making the fold in the intermediate sheet to form the trap cover, often causes the fold to be made directly around the end edge of sheet 18, as shown in FIG. 2. Such a fold has been found to undesirably restrict the flow of the excess composition around the end edge of sheet 18 into trapping space 23. Thus, the use of slits 24 assures that the flow of processing composition is not unduly restricted regardless of the nature of the fold in the intermediate sheet. This also helps relax the manufacturing tolerances which would otherwise be necessary, thus keeping the manufacturing costs down. Likewise, the use of slits 24 has the added manufacturing advantage that no portion of the second sheet is actually removed to form the passage thereby eliminating the need to assure the removal of the removed portion from the film unit on the manufacturing apparatus.

The invention has been described in detail with particular reference to a preferred embodiment thereof, but it will be understood that variations and modifications can be effected within the spirit and scope of the invention.

We claim:

1. In a film unit comprising a photosensitive first sheet and a second sheet, a container for processing composition disposed at one end of the film unit, a trap for excess processing composition disposed at the other end of the film unit, a coupling member permanently securing the sheets together along their lateral edges in superposed relationship, said coupling member extending from between the two sheets at said other end thereof and forming a trap cover folded around said other end of one of the sheets, the improvement comprising trap spacing means including a plurality of protuberances in the end portion of said one sheet at said other end which protuberances extend away from the other of the sheets, the protuberances having a convexity on the side of the one sheet away from the other sheet and corresponding concavity facing the other sheet, said trap cover overlying the protuberances and bounding, with the end portion of said one sheet, a first trapping space to which excess processing composition may flow from between the sheets, the trap including a second trapping space between the sheets at least partially formed by the concavities of the protuberances, and flow passage means including at least one slit through said end portion of said one sheet between said other end and said protuberances to permit flow of said excess processing composition from between said sheets to said first trapping space.

2. The invention according to claim 1 wherein the protuberances are formed as a plurality of circular embossments.

3. The invention according to claim 2 wherein the embossments are arranged in a plurality of rows extending transversely of the film unit.

4. The invention according to claim 3 wherein the embossments in one row are offset from embossments in adjacent rows.

5. The invention according to claim 1 wherein said flow passage means includes a space between the end edge of said one sheet and said trap cover.

6. The invention according to claim 1 wherein said flow passage means includes a plurality of slits extending transversely of said one sheet.

7. The invention according to claim 1 wherein said slit is arcuately shaped.

8. In a film unit comprising a photosensitive first sheet and a second sheet, a container for processing composition disposed at one end of the film unit, a trap for excess processing composition disposed at the other end of the film unit, a coupling member permanently securing the sheets together along their lateral edges in superposed relationship, said coupling member extending from between the two sheets at said other end thereof and forming a trap cover folded around said other end of one of the sheets, the improvement comprising trap spacing means including a plurality of circular embossments forming a plurality of rows of protuberances in the end portion of one sheet at said other end which protuberances extend away from the other of the sheets, the protuberances having a convexity on the side of the one sheet away from the other sheet and a corresponding concavity facing the other sheet, said trap cover overlying the protuberances and bounding, with the end portion of said one sheet, a first trapping space to which excess processing composition may flow from between the sheets, the trap including a second trapping space between the sheets at least partially formed by the concavities of the protuberances, and flow passage means including a plurality of slits extending transversely said one sheet between said other end and said embossments to permit flow of said excess processing composition from between said sheets to said first trapping space.

9. In a photographic film unit including first and second sheets, at least one of said sheets supporting photosensitive material, the sheets defining leading and trailing end portions and lateral edges, at which edges the sheets are secured together in superposed relationship; a container disposed at the leading end portion for supplying a processing composition to between the sheets; and a trap disposed at the trailing end portion for receiving excess of the processing composition from between the sheets; the improvement comprising:

a plurality of embossments in said first sheet at said trailing end portion, said embossments being convex on the side of said first sheet facing away from said second sheet, and concave on the side of said first sheet facing said second sheet;

a trap cover overlying said embossments and bounding with said trailing end portion of said first sheet a first trapping space on the side of said first sheet facing away from said second sheet, the trap including a second trapping space at least partially formed by the concavities of said embossments on the side of said first sheet facing said second sheet; and means extending through said first sheet for passing excess of the processing composition from between said sheets to said first trapping space.

10. An improvement in a photographic film unit as claimed in claim 9, wherein said embossments are circular in configuration.

11. In a film unit comprising a photosensitive first sheet and a second sheet; a container for processing composition disposed at one end of the film unit; a trap for excess processing composition disposed at the other end of the film unit; coupling means permanently securing the sheets together along their lateral edges in superposed relationship, said coupling means extending from between the two sheets at said other end thereof and forming a trap cover folded around said other end of one of the sheets; the improvement comprising:

trap spacing means including a plurality of embossments forming a plurality of rows of protuberances in the end portion of one sheet at said other end which protuberances extend away from the other of the sheets, the protuberances having a convexity on the side of the one sheet away from the other sheet and a corresponding concavity facing the other sheet;

said trap cover overlying the protuberances and bounding, with the end portion of said one sheet, a first substantial trapping space to which excess processing composition may flow from between the sheets, the trap including a second substantial trapping space between the sheets at least partially formed by the concavities of the protuberances; and flow passage means including at least one perforation through said one sheet between said other end and said embossments to permit flow of said excess processing composition from between said sheets to said first trapping space.

12. In a photographic film including first and second sheets, at least one of said sheets supporting photosensitive material, the sheets defining leading and trailing end portions and lateral edges, at which edges the sheets are secured together in superposed relationship; a container disposed at the leading end portion for supplying a processing composition to between the sheets; and a trap disposed at the trailing end portion for receiving excess of the processing composition from between the sheets; the improvement comprising:

a plurality of embossments in said first sheet at said trailing end portion, said embossments being convex on the side of said first sheet facing away from said second sheet, and concave on the side of said first sheet facing said second sheet;

a trap cover extending from between said first and second sheets, folded to overlie said embossments, and bounding with said trailing end portion of said first sheet a first trapping space on the side of said first sheet facing away from said second sheet, said trap including a second trapping space at least partially formed by the concavities of said embossments on the side of said first sheet facing said second sheet; and means for passing excess of the processing composition from between said sheets to said first trapping space.

13. In a photographic film unit including first and second sheets, at least one of said sheets supporting photosensitive material, the sheets defining leading and trailing end portions and lateral edges, at which edges the sheets are secured together in superposed relationship; a container disposed at the leading end portion for supplying a processing composition to between the sheets; and a trap disposed at the trailing end portion for receiving excess of the processing composition from between the sheets; the improvement comprising:

a plurality of embossments in said first sheet at said trailing end portion, said embossments being convex on the side of said first sheet facing away from said second sheet, and concave on the side of said first sheet facing said second sheet; and a trap cover folded around said trailing end portion of said first sheet over said embossments to bound with said trailing end portion of said first sheet a first trapping space on the side of said first sheet facing away from said second sheet, the trap including a second trapping space at least partially formed by the concavities of said embossments on the side of said first sheet facing said second sheet;

said fold in said trap cover being spaced from said trailing end portion of said first sheet for passing excess of the processing composition from between said sheets around said trailing end portion to said first trapping space.

* * * * *

UNITED STATES PATENT AND TRADEMARK OFFICE

CERTIFICATE OF CORRECTION

PATENT NO. : 4,247,626

DATED : January 27, 1981

INVENTOR(S) : Gerald M. Poshkus, Dennis E. Whitney and James N. Cope

It is certified that error appears in the above-identified patent and that said Letters Patent are hereby corrected as shown below:

Item No. [63], "Jan." should read --June--.

Column 1, line 52, "3,589,904" should read --3,607,285--.

Column 3, line 17, after "names" insert --of Lestina et al--.

Signed and Sealed this

*Twelfth* Day of *May 1981*

[SEAL]

*Attest:*

RENE D. TEGTMEYER

*Attesting Officer*

*Acting Commissioner of Patents and Trademarks*